US009335106B1

(12) United States Patent
Simon

(10) Patent No.: US 9,335,106 B1
(45) Date of Patent: May 10, 2016

(54) ADJUSTABLE GAS BLOCK

(71) Applicant: Smith & Wesson Corp., Springfield, MA (US)

(72) Inventor: John Brendan Simon, Springfield, MA (US)

(73) Assignee: Smith & Wesson Corp., Springfield, MA (US)

( * ) Notice: Subject to any disclaimer, the term of this patent is extended or adjusted under 35 U.S.C. 154(b) by 7 days.

(21) Appl. No.: 14/580,822

(22) Filed: Dec. 23, 2014

(51) Int. Cl.
*F41A 5/00* (2006.01)
*F41A 5/26* (2006.01)

(52) U.S. Cl.
CPC ..... *F41A 5/26* (2013.01)

(58) Field of Classification Search
CPC ..... F41A 5/26
USPC ..... 89/193
See application file for complete search history.

(56) References Cited

U.S. PATENT DOCUMENTS 2,462,119 A 2/1949 Moore
3,968,727 A 7/1976 Hyytinen
7,610,844 B2 11/2009 Kuczynko et al.
7,856,917 B2 12/2010 Noveske
7,891,284 B1 2/2011 Barrett
7,934,447 B2 * 5/2011 Kuczynko ..... F41A 5/28 89/193
8,316,756 B1 11/2012 Woodell et al.
8,596,185 B1 12/2013 Soong et al.
8,607,688 B2 12/2013 Cassels
2009/0229454 A1 * 9/2009 Fluhr ..... F41A 5/28 89/193
2012/0167757 A1 7/2012 Gomez
2013/0098235 A1 4/2013 Reinken
2013/0174721 A1 7/2013 Langevin et al.
2013/0269510 A1 * 10/2013 Sullivan ..... F41A 5/28 89/193
2014/0083286 A1 3/2014 Gomez
2014/0090550 A1 4/2014 Wilcox et al.

* cited by examiner

*Primary Examiner* — Samir Abdosh
(74) *Attorney, Agent, or Firm* — John A. Chionchio, Esq.; Ballard Spahr LLP

(57) ABSTRACT

An adjustable gas block is used to regulate the flow rate of gas from a barrel to an action in a gas-operated firearm. The adjustable gas block uses a movable body with an opening having a width and length, the width of the opening varying in size as a function of its length. The movable body is transversely positioned relative to a conduit between the barrel and the action, such that movement of the body and its opening relative to the conduit serves to regulate the flow rate of gas between the barrel and the action.

30 Claims, 7 Drawing Sheets

ADJUSTABLE GAS BLOCK

FIELD OF THE INVENTION

This invention relates to an adjustable gas block assembly used with gas-operated firearms in order to regulate the flow rate of gas passing from the barrel to the action of the firearm.

BACKGROUND

The gas systems in modern sporting rifles can be sensitive to variations in gas flow, pressure, and volume due to changes in ambient temperature, cartridges as they vary from propellant load to load or manufacturer to manufacturer, and/or the use of a suppressor. If there is insufficient gas flow from the barrel to the action in such a firearm, this can lead to short-stroking and misfeeds. On the other hand, a surplus of gas flow back to the action can lead to high action speeds causing forward ejection and trapped cases. In an attempt to regulate gas flow back to the action, some firearms have used a non-adjustable, fixed diameter gas port hole drilled through the barrel bore to establish a fluid connection with a gas tube so as to allow a fixed amount of gas flow back to the action. It is common for original equipment manufacturers to specify this gas port hole larger than would be needed for most available ammunition in order for the firearm to function reliably with the weakest of commercially available ammunition. This results in over-gassing of the firearm. If a suppressor were added to such a firearm, this would increase back pressure and likely lead to malfunctions due to excessive bolt speed.

Based on the inadequacies relating to a fixed diameter gas port holes, there is a need for a design that can optimize gas flow into the action for any given gas operated rifle in light of the numerous gas flow rates, pressures, and volumes realized as a result of variations in ambient temperature, various cartridge loadings, and/or use of a suppressor with the firearm.

SUMMARY

The invention concerns a gas block for a gas operated firearm having a barrel, an action that engages said barrel, and a gas tube for conducting gas from said barrel to said action, said gas block comprising: a housing having a conduit, said conduit having an inlet connectable in fluid communication with said barrel and an outlet connectable in fluid communication with said gas tube; a body movably mounted within said housing and positioned transversely to said conduit between said inlet and said outlet, said body having an opening, said opening having a width and length, said width varying in size as a function of said length, said body being adjustably positionable relative to said conduit to align at least a portion of said opening therewith so as to control said gas passing through said conduit from said barrel to said action.

In an exemplary embodiment, the action of the gas block comprises a bolt carrier and bolt, and in another exemplary embodiment, the action further comprises a piston and rod.

In an exemplary embodiment, the opening in the body in the gas block is selected from the group consisting of the following: a teardrop shaped perimeter, V-shaped perimeter, and a parabolic shaped perimeter. In another exemplary embodiment, the body in the gas block comprises a plate or plug having a plane oriented transversely to said conduit.

In an exemplary embodiment, the gas block further comprises a body comprising a bore, said bore having internal threading; a threaded shaft rotatably mounted within said housing and received within said bore, said threaded shaft having a longitudinal axis oriented transversely to said conduit, said body being movable along said axis within said housing relative to said conduit upon rotation of said threaded shaft. In another exemplary embodiment, the body in the gas block comprises a plate or plug having a plane oriented transversely to said conduit; and wherein a tube affixed to said plate or plug defines said bore. In another exemplary embodiment, the gas block further comprises a knob situated outside of said housing and connected to said threaded shaft for manual rotation thereof. In another exemplary embodiment, the gas block further comprises a detent situated between said knob and said housing.

In another exemplary embodiment, the gas block further comprises a plurality of receptacles arranged on a surface of said knob facing said housing; a projection positioned within said housing and movable outwardly therefrom toward said knob, said projection being biased toward said knob and engageable with at least one of said receptacles upon rotation of said shaft. In another exemplary embodiment, the projection in the gas block comprises a ball, said ball being positioned within a cavity within said housing, a spring being positioned within said cavity and acting between said housing and said ball to bias said ball toward said knob. In another exemplary embodiment, said receptacles of the gas block are arranged in a circle around said knob. In another exemplary embodiment, said receptacles comprise concavities in said surface.

In another exemplary embodiment, the gas block further comprises a panel mounted on said shaft between said knob and said body, said panel having a plurality of receptacles; a projection positioned within said housing and movable outwardly therefrom toward said panel, said projection being biased toward said panel and engageable with at least one of said receptacles upon rotation of said shaft. In yet another exemplary embodiment, said projection within the gas block comprises a ball, said ball being positioned within a cavity within said housing, a spring being positioned within said cavity and acting between said housing and said ball to bias said ball toward said panel. In another exemplary embodiment, said receptacles for the gas block are arranged in a circle surrounding said shaft. In yet another exemplary embodiment, said receptacles comprise holes. In yet another exemplary embodiment, said panel in the gas block comprises a disk fixedly mounted on said shaft.

In another exemplary embodiment, the gas block further comprises a collar attached to said panel and surrounding said shaft; a clutch being manually engageable with said shaft so as to rotationally fix said collar and said panel to said shaft. In another exemplary embodiment, said panel comprises a disk. In another exemplary embodiment, the clutch comprises a screw extending through a threaded opening in said collar, said threaded opening extending transversely to said shaft.

The invention also concerns a gas operated firearm, comprising a barrel; an action engageable with said barrel; a gas tube for conducting gas from said barrel to said action; a gas block mounted on said barrel, said gas block comprising: a housing having a conduit, said conduit having an inlet connected in fluid communication with said barrel and an outlet connected in fluid communication with said gas tube; a body movably mounted within said housing and positioned transversely to said conduit between said inlet and said outlet, said body having an opening, said opening having a width and length, said width varying in size as a function of said length, said body being adjustably positionable relative to said conduit to align at least a portion of said opening therewith so as to control said gas passing through said conduit from said barrel to said action. In an exemplary embodiment, said action comprises a bolt carrier and bolt, and in another exemplary embodiment said action further comprises a piston and rod.

In an exemplary embodiment, the opening in the body in the gas block for the gas operated firearm is selected from the group consisting of the following: a teardrop shaped perimeter, a V-shaped perimeter, and a parabolic shaped perimeter. In another exemplary embodiment, the body comprises a plate or plug having a plane oriented transversely to said conduit.

In another exemplary embodiment, the gas block in the gas operated firearm further comprises said body comprising a bore, said bore having internal threading; a threaded shaft rotatably mounted within said housing and received within said bore, said threaded shaft having a longitudinal axis oriented transversely to said conduit, said body being movable along said axis within said housing relative to said conduit upon rotation of said threaded shaft.

In another exemplary embodiment, said body in the gas block in the gas operated firearm comprises a plate or plug having a plane oriented transversely to said conduit; and wherein a tube affixed to said plate or plug defines said bore. In another exemplary embodiment, the gas block in the gas operated firearm further comprises a knob situated outside of said housing and connected to said threaded shaft for manual rotation thereof. In another embodiment, the gas block in the gas operated firearm further comprises a detent situated between said knob and said housing. In another exemplary embodiment, the gas block of the gas operated firearm further comprises: a plurality of receptacles arranged on a surface of said knob facing said housing; a projection positioned within said housing and movable outwardly therefrom toward said knob, said projection being biased toward said knob and engageable with at least one of said receptacles upon rotation of said shaft.

In yet another exemplary embodiment, the projection in the gas block in the gas operated firearm comprises a ball, said ball being positioned within a cavity within said housing, a spring being positioned within said cavity and acting between said housing and said ball to bias said ball toward said knob. In another exemplary embodiment, said receptacles in the gas block of the gas operated firearm are arranged in a circle around said knob. In another exemplary embodiment, said receptacles comprise concavities in said surface.

In another exemplary embodiment, the gas block of the gas operated firearm further comprises a panel mounted on said shaft between said knob and said body, said panel having a plurality of receptacles; a projection positioned within said housing and movable outwardly therefrom toward said panel, said projection being biased toward said panel and engageable with at least one of said receptacles upon rotation of said shaft. In another exemplary embodiment, said projection comprises a ball, said ball being positioned within a cavity within said housing, a spring being positioned within said cavity and acting between said housing and said ball to bias said ball toward said panel. In another exemplary embodiment, said receptacles are arranged in a circle surrounding said shaft. In yet another exemplary embodiment, said receptacles comprise holes.

In another exemplary embodiment, the panel in the gas block of the gas operated firearm comprises a disk fixedly mounted on said shaft.

In another exemplary embodiment, the gas block of the gas operated firearm further comprises a collar attached to said panel and surrounding said shaft; a clutch being manually engageable with said shaft so as to rotationally fix said collar and said panel to said shaft.

In another exemplary embodiment, the panel in the gas block of the gas operated firearm comprises a disk.

In another exemplary embodiment, the clutch in the gas block of the gas operated firearm comprises a screw extending through a threaded opening in said collar, said threaded opening extending transversely to said shaft.

The invention also concerns a gas block for a gas operated firearm having a barrel, an action that engages said barrel, said gas block comprising: a housing having a conduit with an inlet and an outlet for providing a fluid communication between said barrel and said action; a body movably mounted within said housing and positioned transversely to said conduit between said inlet and said outlet, said body having an opening, said opening having a width and length, said width varying in size as a function of said length, said body being adjustably positionable relative to said conduit to align at least a portion of said opening therewith so as to control said gas passing through said conduit from said barrel to said action. In another exemplary embodiment, said action comprises a bolt carrier and bolt, and in another exemplary embodiment, said action further comprises a piston and rod.

In an exemplary embodiment, the gas block further comprises a gas tube for providing fluid communication between said barrel and said action, said inlet of said conduit being in fluid communication with said barrel and said outlet of said conduit being in fluid communication with said gas tube.

The invention also concerns a gas operated firearm, comprising: a barrel, an action engageable with said barrel; a gas block comprising: a housing mounted on said firearm, said housing having a conduit with an inlet and an outlet for establishing fluid communication between said barrel and said action; a body movably mounted within said housing and positioned transversely to said conduit between said inlet and said outlet, said body having an opening, said opening having a width and a length, said width varying in size as a function of said length, said body being adjustably positionable relative to said conduit to align at least a portion of said opening therewith so as to control said gas passing through said conduit from said barrel to said action. In another exemplary embodiment, said action comprises a bolt carrier and bolt, and in another exemplary embodiment, said action further comprises a piston and rod.

In another exemplary embodiment, the gas operated firearm further comprises a gas tube extending between said barrel and said action, said housing being mounted on said barrel, said inlet of said conduit being in fluid communication with said barrel, said outlet of said conduit being in fluid communication with said gas tube, said gas tube providing fluid communication between said gas block and said action.

DETAILED DESCRIPTION

Figure 1A:
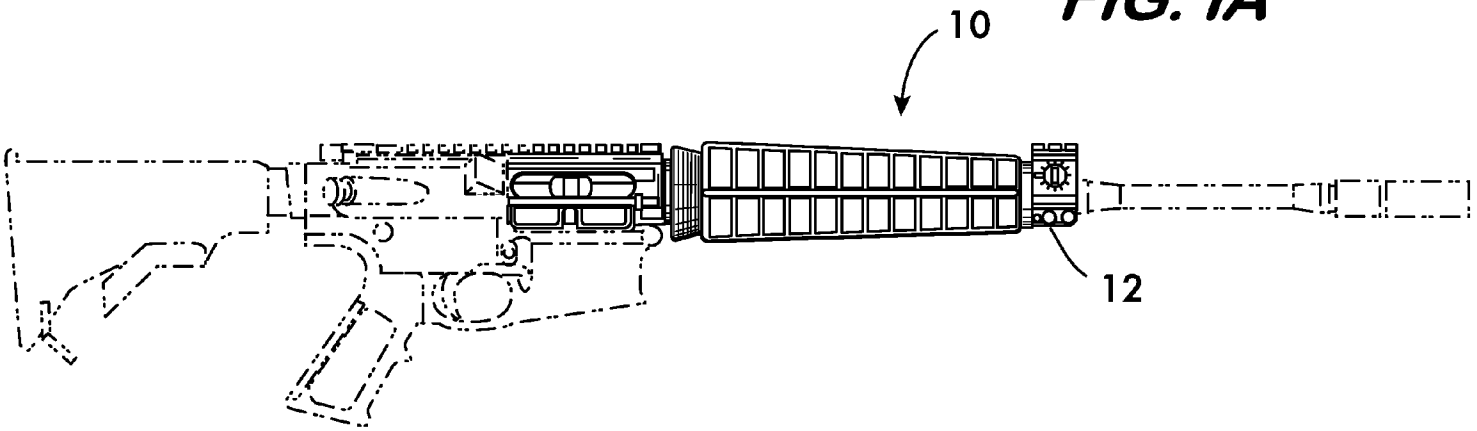
FIG. 1A shows a side view of an exemplary gas-operated firearm with an exemplary embodiment of an adjustable gas block according to the present invention.

FIG. 1A shows a gas operated firearm 10 having a gas block 12 according to the present invention. The gas block 12 may be attached to the end of barrel as shown in the figure, but can also be attached to the receiver. In either case, the gas block 12 will regulate the flow rate of gas from the barrel to the action. As will be described in further detail below, the gas block 12 can be manually adjusted to infinitely vary the amount of gas flow within the gas operated firearm 10.

Figure 1C:
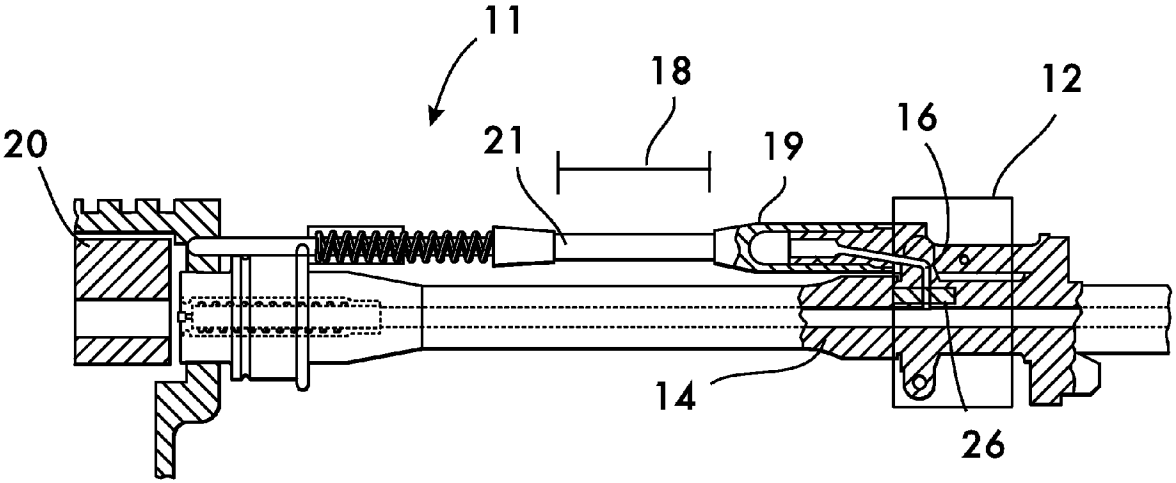
FIG. 1C shows a partial, vertical cross-sectional view of another exemplary gas operated firearm with an exemplary embodiment of an adjustable gas block according to the present invention.
Figure 1B:
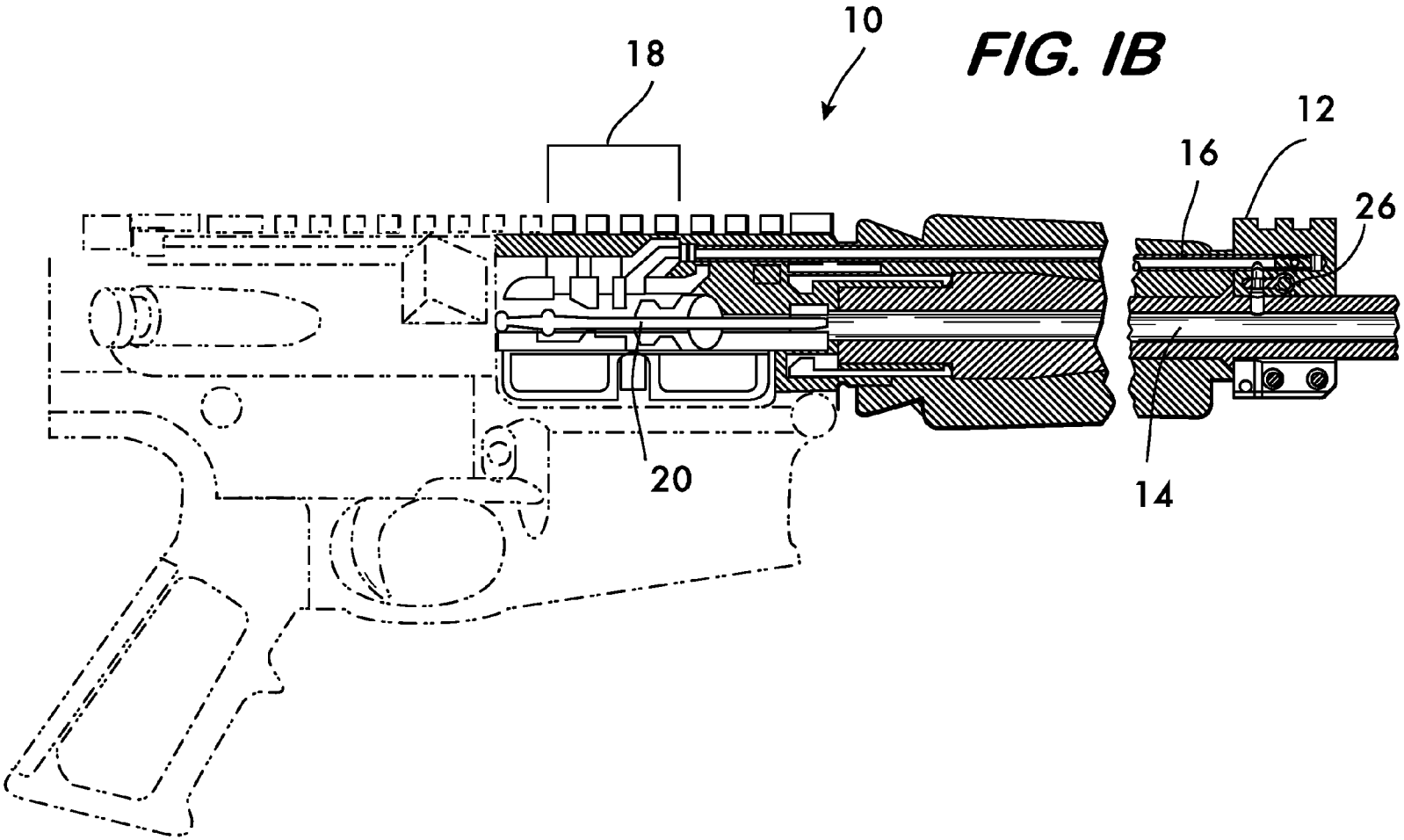
FIG. 1B shows a partial, vertical cross-sectional view of the gas-operated firearm from FIG. 1A.

FIG. 1B shows the path of gas flow and the inner fluid connections of firearm 10. After a round of ammunition is fired from the firearm 10, the gas associated with the discharge of the round travels through a barrel 14 and a portion is diverted into a gas tube 16. The gas then travels through the gas tube 16 into an action 18. In FIG. 1B, the action 18 comprises a bolt carrier carrying a bolt 20 that is engageable with barrel 14. This configuration is appropriate for a gas impingement system for the gas operation. Alternatively, FIG. 1C depicts another gas operated firearm 11 having an action 18 that comprises a piston 19 and rod 21 that engages a bolt carrier carrying a bolt 20 that is engageable with barrel 14. The flow rate of the gas passing from the barrel 14 to the action 18 controls the speed of the bolt carrier carrying a bolt 20 as it moves out of battery to extract the spent casing. Motion of the bolt carrier carrying a bolt 20 compresses a return spring (not shown) which moves the bolt carrier carrying a bolt 20 back into battery, loading the next round of ammunition into the chamber of the firearm. In the exemplary embodiments shown in FIGS. 1B and 1C, the gas block 12 is used to regulate the amount of gas flow by varying the flow rate from the barrel 14 to the gas tube 16. As mentioned, the gas block 12 can also be used to regulate the amount of gas flow by varying the flow rate from the gas tube 16 to the action 18. In either embodiment, the gas flow used to move the bolt out of battery and extract a spent round can be varied so as to, among other things, accommodate differently manufactured rounds, ambient temperatures, and/or the usage of a suppressor or silencer.

Figure 2:
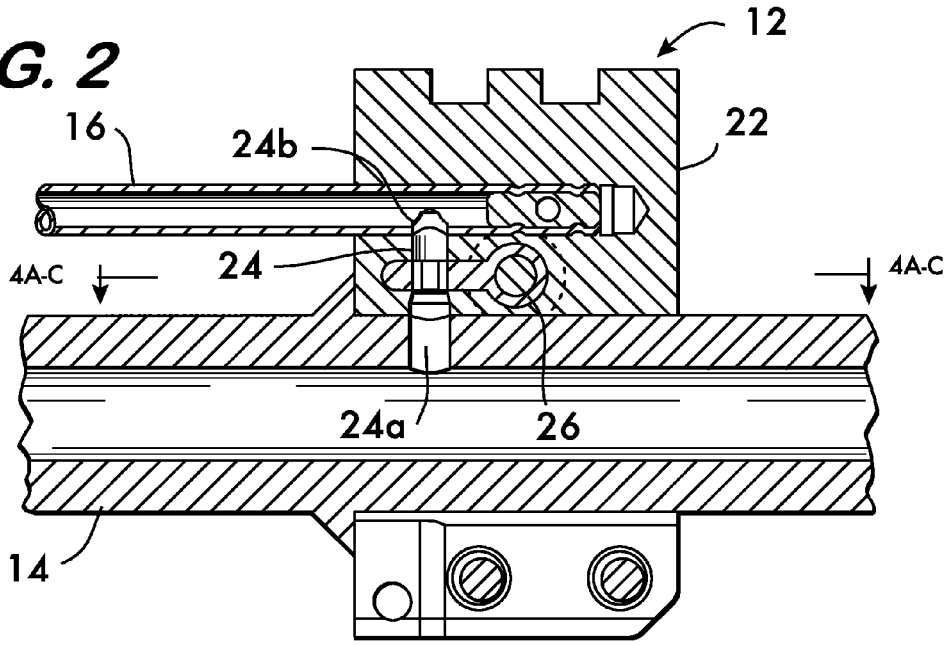
FIG. 2 shows a vertical cross-sectional view of an exemplary gas block according to the present invention.

FIG. 2 shows the ability of the gas block 12 to vary the gas flow into the gas tube 16 in an exemplary embodiment. The gas block 12 comprises a housing 22 that can be connected to barrel 14 and gas tube 16. The barrel 14 contains a conduit 24 that comprises an inlet 24*a* and an outlet 24*b*, which can establish fluid communication between the barrel 14 and gas tube 16. The housing 22 further includes a movable body 26 that is transversely positioned to the conduit 24. The positioning of movable body 26 can be at any angle provided that it is capable of controlling the flow rate of gas passing from the barrel 14 to the gas tube 16.

Figure 3A:
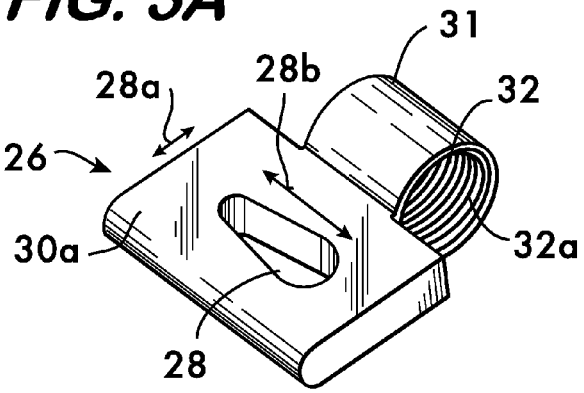
FIG. 3A shows an isometric view of a movable body comprising a teardrop shaped perimeter and a plate as an exemplary embodiment to be used in the present invention.
Figure 3B:
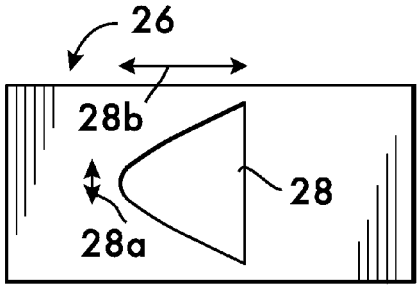
FIG. 3B shows a top view of a movable body comprising a parabolic shaped perimeter as an exemplary embodiment to be used in the present invention.
Figure 3C:
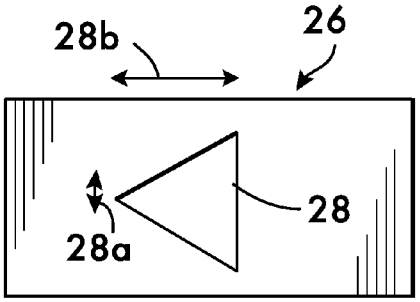
FIG. 3C shows a top view of a movable body comprising a V-shaped perimeter as an exemplary embodiment to be used in the present invention.
Figure 3D:
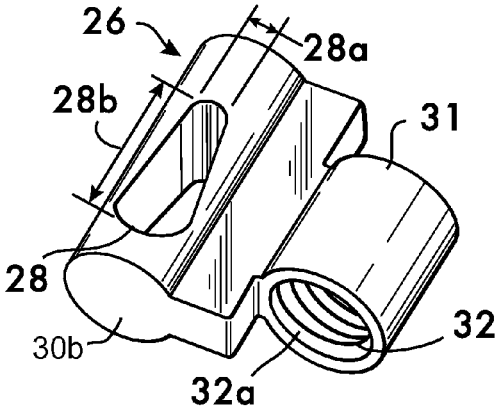
FIG. 3D shows an isometric view of a movable body comprising a teardrop shaped perimeter and a plug as an exemplary embodiment to be used in the present invention.

As shown in FIG. 3A, according to an exemplary embodiment the movable body 26 may be comprised of an opening 28 in a plate 30*a*, and a tube 31 defining a bore 32 with internal threading 32*a*. Alternatively, as shown in FIG. 3D, according to an exemplary embodiment the movable body 26 may be comprised of an opening 28 in a plug 30*b*. The plug 30*b* may be cylindrical or any other appropriate shape such that it has the ability to avoid leaks in the gas flow around the movable body 26. In any embodiment, the opening 28 has an opening width 28*a* and an opening length 28*b* that define the perimeter of the opening 28. The opening 28 is depicted as having a teardrop shaped perimeter in FIGS. 3A and 3D as exemplary embodiments, but the perimeter of the opening may be of any suitable shape known to a person of ordinary skill such that it will achieve its intended purpose as described herein. Such shapes include, but not are not limited to, a parabolic shaped opening 28 (as depicted in FIG. 3B) or a V-shaped opening 28 (as depicted in FIG. 3C).

The plate 30*a* or plug 30*b* can be moved transversely to the conduit 24 such that various portions of the opening 28 are placed into fluid communication with the conduit 24. The movable body 26 with opening 28 can be adjusted to range from full fluid communication between the barrel 14 and the gas tube 16 to no fluid communication between the barrel 14 and gas tube 16. Similarly, the movable body 26 with opening 28 can be adjusted to range from full fluid communication between the gas tube 16 and action 18 to no fluid communication between the gas tube 16 and action 18. Like the opening 28, the body 26 may be comprised of any structure and shape known to a person of ordinary skill such that it will achieve its intended purpose as described herein.

Figure 4A:
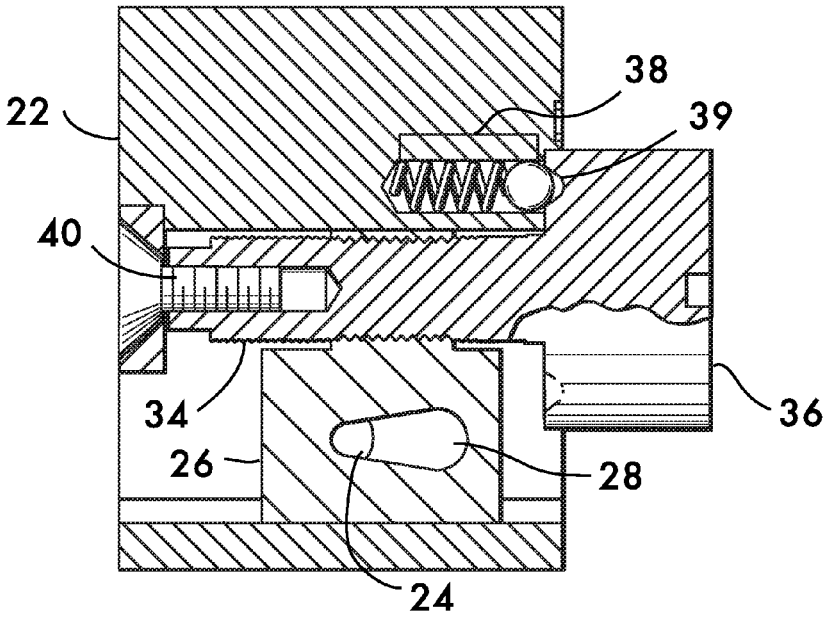
FIGS. 4A-4C show a horizontal cross-sectional views of an exemplary gas block according to the present invention and illustrating its operation.
Figure 4B:
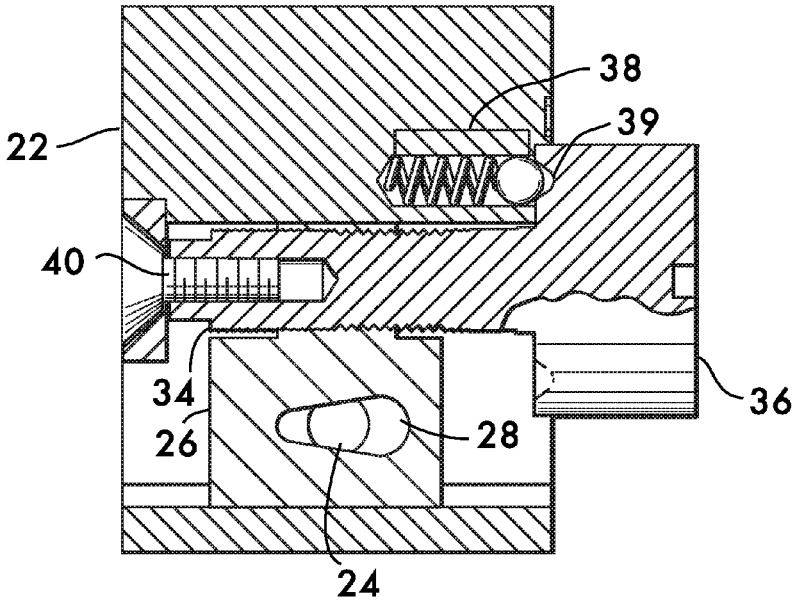
Figure 4C:
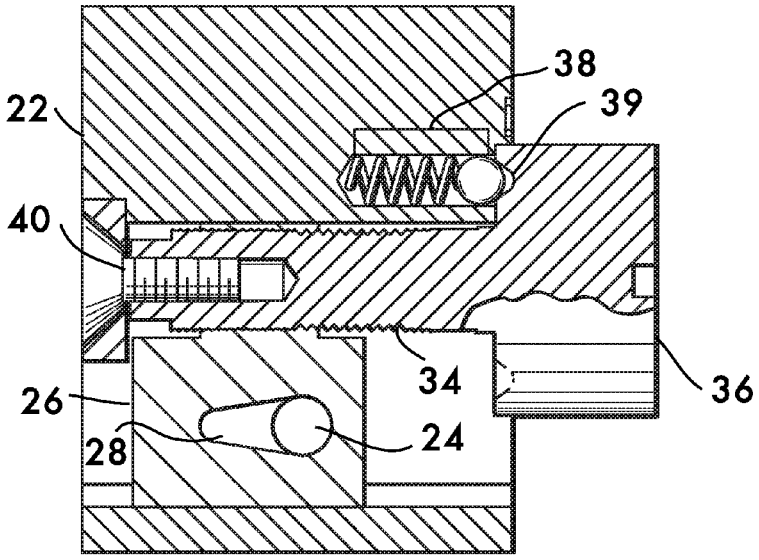

FIGS. 4A-4C show an exemplary mechanism of operation of the movable body 26 within the housing 22. FIG. 4A shows a horizontal cross-sectional view of the movable body 26 within housing 22 according to an exemplary embodiment of the invention. Within the housing 22 there is a threaded shaft 34 that can be mounted within the housing and mated with an inner screw 40, which retains the threaded shaft 34 within the housing 22. The threaded shaft 34 can be connected to a knob 36 such that rotation of the knob 36 serves to rotate the threaded shaft 34 relative to the housing 22. Upon rotation of the knob 36, the movable body 26 translates along the threaded shaft 34, which serves to vary the position of the opening 28 with respect to the conduit 24. The knob 36 can be manually rotated or rotating using any tool known to a person of ordinary skill in the art. For the exemplary embodiment shown in FIG. 4A, the knob 36 can be adjusted and positioned using any detent 38 known to a person of ordinary skill in the art. In this exemplary embodiment, the knob may comprise a detent hole 39 that engages the detent 38, which as shown may comprise a spring loaded ball that exerts outward pressure facing the inside of the knob 36 such that the ball mates with a detent hole 39 on the knob 36. The detent 38 may comprise any other components known to a person of ordinary skill to achieve the functions described. Upon the detent 38 mating with detent hole 39, the knob can be fixedly positioned; however, with sufficient rotational force, the knob 36 can be rotated until the detent 38 mates with the next detent hole 39. The detent holes can be evenly or unevenly spaced around the circumference of the knob 36. And the spacing between the holes can vary according to how finely the user wishes to be able to adjust the knob. As can be seen in FIG. 4A, a certain amount of gas flow is permitted through conduit 24 as per the alignment of the opening 28 with the conduit. This setting can be used to accommodate variations in gas flow rates, pressures, and volumes realized as a result of changes in ambient temperature, cartridge loadings, and/or use of a suppressor with the firearm.

FIG. 4B shows the same horizontal cross-sectional view of movable body 26 within housing 22 according to an exemplary embodiment of the invention, but with the movable body 26 now adjusted such that the opening allows for more gas flow through conduit 24 upon rotation of the knob 36. Again, this setting can be used to accommodate variations in gas flow, pressures, and volumes realized as a result of changes in ambient temperature, cartridge loadings, and/or use of a suppressor with the firearm.

FIG. 4C shows the same horizontal cross-sectional view of movable body 26 within housing 22 according to an exemplary embodiment of the invention, but with the movable body 26 now positioned such that the opening allows for maximal gas flow through conduit 24 upon rotation of the knob 36. This setting can be used to allow for the maximal amount of gas flow that is allowed by the diameter of the conduit 24.

Figure 5:
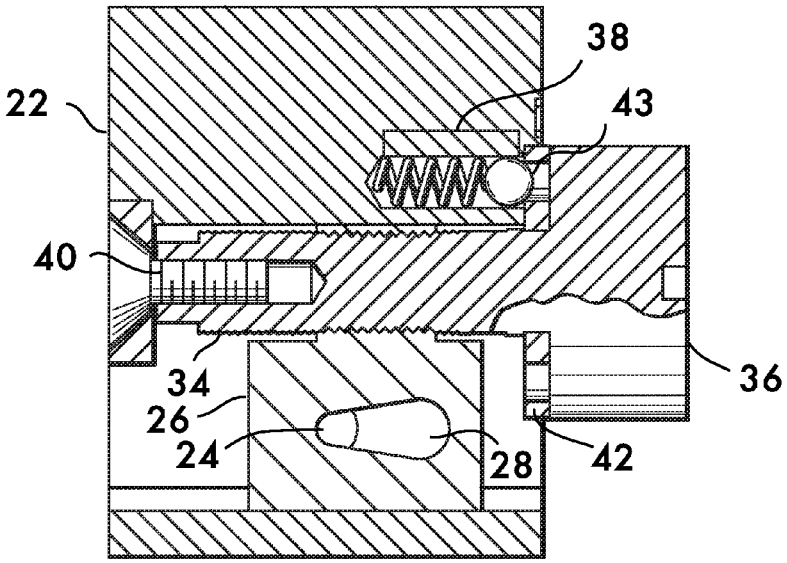
FIG. 5 shows a horizontal cross-sectional view of a gas block according to FIG. 4A with the addition of a panel according to an exemplary embodiment of the invention.

In another exemplary embodiment as shown in FIG. 5, a panel 42 may be employed between the detent 38 and the knob 36, wherein the panel has detent holes 43 that can mate with detent 38. The panel 42 can be connected to the knob 36 such that rotation of the knob rotates the panel as well. In such an exemplary embodiment, the knob 36 need not have any detent holes itself.

Figure 6:
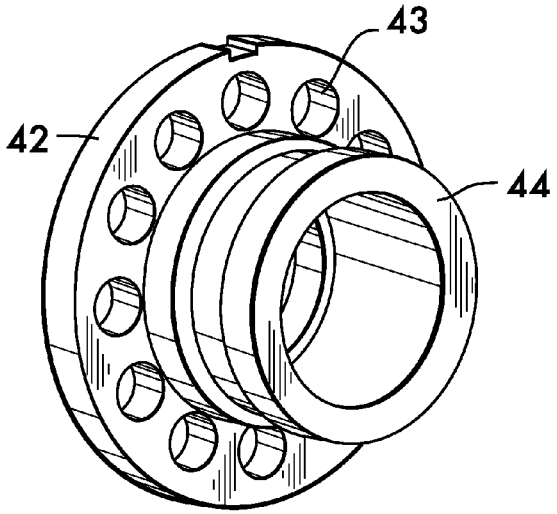
FIG. 6 shows an isometric view of the panel from FIG. 5 with the addition of a collar according to an exemplary embodiment of the invention.
Figure 7:
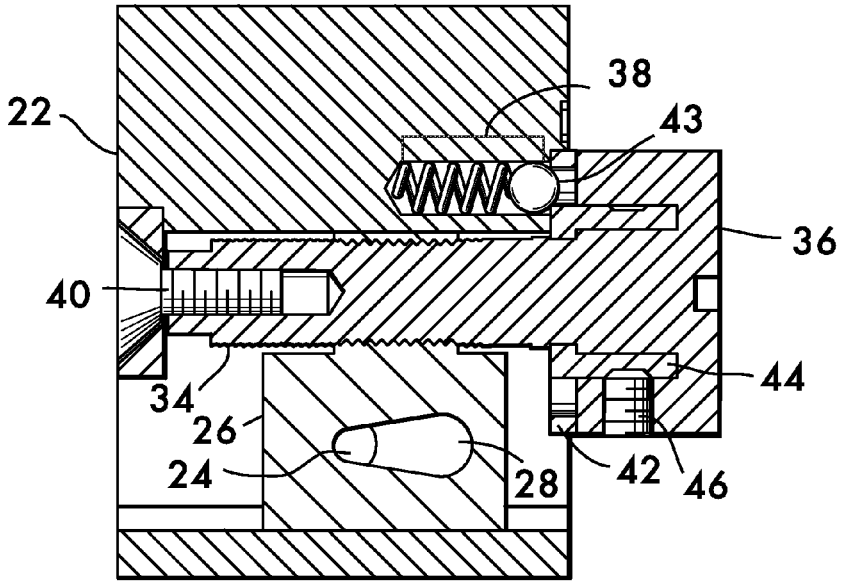
FIG. 7 shows a horizontal cross-sectional view of a gas block according to FIG. 4A and including the panel and collar from FIG. 6 according to an exemplary embodiment of the invention.

Further, as shown in FIG. 6, the panel 42 can have a collar 44 that projects axially from the panel. The collar 44 may reside within the knob 36 as shown in FIG. 7. In this exemplary embodiment, the knob 36 is engageable with the collar 44 through a clutch 46 such that rotation of the knob rotates the collar 44 and panel 42. This rotation allows the detent 38 to engage and disengage the detent holes 43 of the panel 42. This exemplary embodiment therefore allows for rotation of both the knob 36 and panel 42. Alternatively, when the clutch 46 is not engaged, the knob 36 and threaded shaft 34 can rotate independently of the detent 38. In this way, the knob and threaded shaft can be infinitely adjustable, thereby allowing for the infinite adjustment of the opening 28 with respect to the conduit 24. The threading of the inner screw 40 and the threading of the threaded shaft 34 may be spaced such that the knob 36 does not rotate independent of application of moderate or heavy force applied by a user when intending to adjust the knob 36. The clutch 46 as described above can be a screw, set screw, or any other structure known to a person of ordinary skill that would serve to reversibly engage the knob 36 with the collar 44. The clutch 46 can be engaged by hand or through use of a tool, including but not limited to a screwdriver, or any other tool known to a person of ordinary skill in the art.

What is claimed is:

1. A gas block for a gas operated firearm having a barrel, an action that engages said barrel, and a gas tube for conducting gas from said barrel to said action, said gas block comprising:

a housing having a conduit, said conduit having an inlet connectable in fluid communication with said barrel and an outlet connectable in fluid communication with said gas tube;

a body movably mounted within said housing and positioned transversely to said conduit between said inlet and said outlet, said body having an opening, said opening having a width and length, said width varying in size as a function of said length, said body being adjustably positionable relative to said conduit to align at least a portion of said opening therewith so as to control said gas passing through said conduit from said barrel to said action.

2. The gas block according to claim 1, wherein said action comprises a bolt carrier and bolt.

3. The gas block according to claim 2, wherein said action further comprises a piston and rod.

4. The gas block according to claim 1, wherein said opening is selected from the group consisting of the following: a teardrop shaped perimeter, V-shaped perimeter, and a parabolic shaped perimeter.

5. The gas block according to claim 1, wherein said body comprises a plate having a plane oriented transversely to said conduit.

6. The gas block according to claim 1, wherein said body comprises a plug.

7. The gas block according to claim 1, further comprising:

said body comprising a bore, said bore having internal threading;

a threaded shaft rotatably mounted within said housing and received within said bore, said threaded shaft having a longitudinal axis oriented transversely to said conduit, said body being movable along said axis within said housing relative to said conduit upon rotation of said threaded shaft.

8. The gas block according to claim 7, wherein:

said body comprises a plug; and wherein a tube affixed to said plug defines said bore.

9. The gas block according to claim 7, further comprising a knob situated outside of said housing and connected to said threaded shaft for manual rotation thereof.

10. The gas block according to claim 9, further comprising a detent situated between said knob and said housing.

11. The gas block according to claim 9, further comprising:

a panel mounted on said shaft between said knob and said body, said panel having a plurality of receptacles;

a projection positioned within said housing and movable outwardly therefrom toward said panel, said projection being biased toward said panel and engageable with at least one of said receptacles upon rotation of said shaft.

12. The gas block according to claim 11, wherein said panel comprises a disk fixedly mounted on said shaft.

13. The gas block according to claim 11, further comprising:

a collar attached to said panel and surrounding said shaft;

a clutch being manually engageable with said shaft so as to rotationally fix said collar and said panel to said shaft.

14. The gas block according to claim 13, wherein said panel comprises a disk.

15. The gas block according to claim 13, wherein said clutch comprises a screw extending through a threaded opening in said collar, said threaded opening extending transversely to said shaft.

16. A gas operated firearm, comprising:

a barrel;

an action engageable with said barrel;

a gas tube for conducting gas from said barrel to said action;

a gas block mounted on said barrel, said gas block comprising:

a housing having a conduit, said conduit having an inlet connected in fluid communication with said barrel and an outlet connected in fluid communication with said gas tube;

a body movably mounted within said housing and positioned transversely to said conduit between said inlet and said outlet, said body having an opening, said opening having a width and length, said width varying in size as a function of said length, said body being adjustably positionable relative to said conduit to align at least a portion of said opening therewith so as to control said gas passing through said conduit from said barrel to said action.

17. The gas operated firearm according to claim 16, wherein said action comprises a bolt carrier and bolt.

18. The gas operated firearm according to claim 17, wherein said action further comprises a piston and rod.

19. The gas operated firearm according to claim 16, wherein said opening is selected from the group consisting of the following: a teardrop shaped perimeter, a V-shaped perimeter, and a parabolic shaped perimeter.

20. The gas operated firearm according to claim 16, wherein said body comprises a plate having a plane oriented transversely to said conduit.

21. The gas operated firearm according to claim 16, wherein said body comprises a plug.

22. The gas operated firearm according to claim 16, further comprising:

said body comprising a bore, said bore having internal threading;

a threaded shaft rotatably mounted within said housing and received within said bore, said threaded shaft having a longitudinal axis oriented transversely to said conduit, said body being movable along said axis within said housing relative to said conduit upon rotation of said threaded shaft.

23. The gas operated firearm according to claim 22, wherein:

said body comprises a plug; and wherein a tube affixed to said plug defines said bore.

24. The gas operated firearm according to claim 22, further comprising a knob situated outside of said housing and connected to said threaded shaft for manual rotation thereof.

25. The gas operated firearm according to claim 24, further comprising a detent situated between said knob and said housing.

26. The gas operated firearm according to claim 24, further comprising:

a panel mounted on said shaft between said knob and said body, said panel having a plurality of receptacles;

a projection positioned within said housing and movable outwardly therefrom toward said panel, said projection being biased toward said panel and engageable with at least one of said receptacles upon rotation of said shaft.

27. The gas operated firearm according to claim 26, wherein said panel comprises a disk fixedly mounted on said shaft.

28. The gas operated firearm according to claim 26, further comprising:

a collar attached to said panel and surrounding said shaft;

a clutch being manually engageable with said shaft so as to rotationally fix said collar and said panel to said shaft.

29. The gas operated firearm according to claim 28, wherein said panel comprises a disk.

30. The gas operated firearm according to claim 28, wherein said clutch comprises a screw extending through a threaded opening in said collar, said threaded opening extending transversely to said shaft.

* * * * *